United States Patent [19]

Schenck et al.

[11] 4,167,004

[45] Sep. 4, 1979

[54] APPARATUS FOR DETECTING PLURAL REPETITIVE SIGNALS

[75] Inventors: Arthur J. Schenck, Phillipsburg, N.J.; Richard H. Krause, Coopersburg, Pa.

[73] Assignee: Bethlehem Steel Corporation, Bethlehem, Pa.

[21] Appl. No.: 892,009

[22] Filed: Mar. 30, 1978

[51] Int. Cl.[2] ..... G08B 23/00; G06F 7/04; H03K 21/36

[52] U.S. Cl. ..... 340/679; 235/92 FQ; 235/92 SH; 307/233 R; 340/171 A; 340/517; 364/468; 364/552

[58] Field of Search ..... 340/517, 520, 526, 673, 340/675, 679, 171 R, 171 A; 364/507, 550, 552, 476, 478, 468; 235/92 SH, 92 FQ; 214/1 MD; 226/10, 100; 73/104, 105; 307/233; 328/140, 141; 324/216; 250/562

[56] References Cited

U.S. PATENT DOCUMENTS

| | | | |
|---|---|---|---|
| 3,551,889 | 12/1970 | Miller | 340/171 |
| 3,609,683 | 9/1971 | Hoffmanet al. | 340/146.2 |
| 3,673,493 | 6/1972 | Hoffman et al. | 324/37 |
| 3,882,545 | 5/1975 | Titus | 340/171 A X |
| 3,925,650 | 12/1975 | Brown | 235/164 |
| 3,927,259 | 12/1975 | Brown | 179/1 MN |
| 4,052,700 | 10/1977 | Soobik et al. | 340/171 R X |
| 4,110,725 | 8/1978 | Petrosky | 340/171 A X |

*Primary Examiner*—John W. Caldwell, Sr.
*Assistant Examiner*—Joseph E. Nowicki
*Attorney, Agent, or Firm*—Joseph J. O'Keefe; Michael J. Delaney; George G. Dower

[57] ABSTRACT

Repetitive defect signals are produced, for example, by bar or rod inspection equipment whenever any one of plural roll sets in a rolling mill develops a roll crack. Defect signal repetitive rate differs for each roll's relative speed. Selective correlator electronics process the defect signals with plural repetitive rates and produce an output signal indicative of which roll set in the mill has a cracked roll.

11 Claims, 12 Drawing Figures

NOT TO SCALE
NOT TO SCALE
NOT TO SCALE
Z
Y
X
41
42
43
44
45
46
47
48
52
67
68
73
74
77
78
43-1
43-2
43-3
43-4
43-5
43-6
43-12
43-N
45-1
45-2
45-3
45-6
45-N
47-1
47-2
47-N

APPARATUS FOR DETECTING PLURAL REPETITIVE SIGNALS

BACKGROUND OF THE INVENTION

Field of the Invention

This invention relates broadly to apparatus for processing variable repetitive input signals. More particularly, the invention relates to apparatus for selectively detecting variable repetitive input signals according to one of plural repetitive rates. The invention may be used with, among other things, moving bar or rod surface inspection equipment in a variablespeed rolling mill to facilitate identifying cracked rolls which produce repetitive transverse defects on the rolled product surface.

In such bar or rod rolling mills a roll crack may develop in any one of plural roll sets. Each set of rolls rotate at a different roll speed which is proportionate to one another. The resulting transverse defect is repeated lengthwise of the rolled product surface at a repetitive rate commensurate with cracked roll speed and location until the roll is changed. Consequently, the transverse defects may occur at any one of plural repetitive rates, depending on which of the plural roll sets contains the cracked roll.

In present highspeed bar or rod rolling mills, where bar or rod is rolled at respective speeds of up to 1220 mpm (about 4,000 fpm) and 3660 mpm (about 12,000 fpm), the rolled product is passed through surface inspection equipment to obtain full inspection of each rolled product before shearing or coiling operations. This procedure results in greater accuracy, reliability and less off-specification product than heretofore when only periodic sampling of the packaged order was made and this followed by a visual examination of the surface for cracked roll marks.

Prior art surface inspection equipment frequently comprises eddy-current apparatus having either a stationary or a rotating probe and an electronics package. The rolled product is passed through the probe and the electronics package generates a defect signal whenever the probe detects a defect on the surface of the rolled product. One of the problems with the prior art apparatus, both stationary and rotating probe type, is that they do not automatically detect repetitive defect signals caused by the cracked roll marks repeating lengthwise on the surface of the rolled product. Another problem with the prior art apparatus is that there is no correlation of repetitive defect signals with the particular roll set in a rolling mill having a cracked roll that causes the repetitive defect signals to be generated. In one instance, correlation circuitry is provided for distinguishing between true defect signals from false signals and noise, and to correlate defect angular position about a round bar surface but not a lengthwise correlation circuit. Even in data communication and acoustics arts where conventional auto- and cross-correlation techniques are used to enhance a signal over a noisy background, there is no teaching as to correlation of repetitive defect signals with a repetitive source causing the defect.

SUMMARY OF THE INVENTION

A main object of the present invention is to provide improved apparatus for detecting variable repetitive input signals.

Another object of this invention is to provide improved apparatus for signalling an operator as to which one of plural repetitive rate input signal sources a variable input signal is associated with.

The foregoing objects may be achieved by processing variable repetitive input signals in selective correlator electronics as opposed to auto- or cross-correlator electronics. The selective correlator electronics includes comparator means for producing an input signal pulse train above a noise level, clock means responsive to an external clock source for generating plural clocking pulses, one at each different repetitive rate of the input pulse train, shift register means having plural data inputs each parallel-connected to the pulse train and plural clock inputs each connected to a different clocking pulse, logic means receiving full groups of the plural shift register outputs for generating one of plural output signals indicative of a particular one of the repetitive rates of the input signal. Output signals activate repetitive rate indicators, alarms and the like.

In a particular bar or rod mill installation, repetitive defect signals caused by cracked roll marks are processed in the selective correlator electronics whereby a defect pulse train, having one of plural repetitive rates, is clocked through the parallel-connected shift registers, each at a different rate corresponding to one of the roll speeds as determined by a mill roll speed tachometer, and each output signal corresponds to one of plural cracked roll sets that produces the repetittive defect signal being processed. The indicators and alarms inform operating personnel to change a particular cracked roll.

BRIEF DESCRIPTION OF THE DRAWINGS

FIGS. 3A to 3K waveforms are referred to in parentheses on the drawings.

DESCRIPTION OF THE PREFERRED EMBODIMENT

Figure 1:
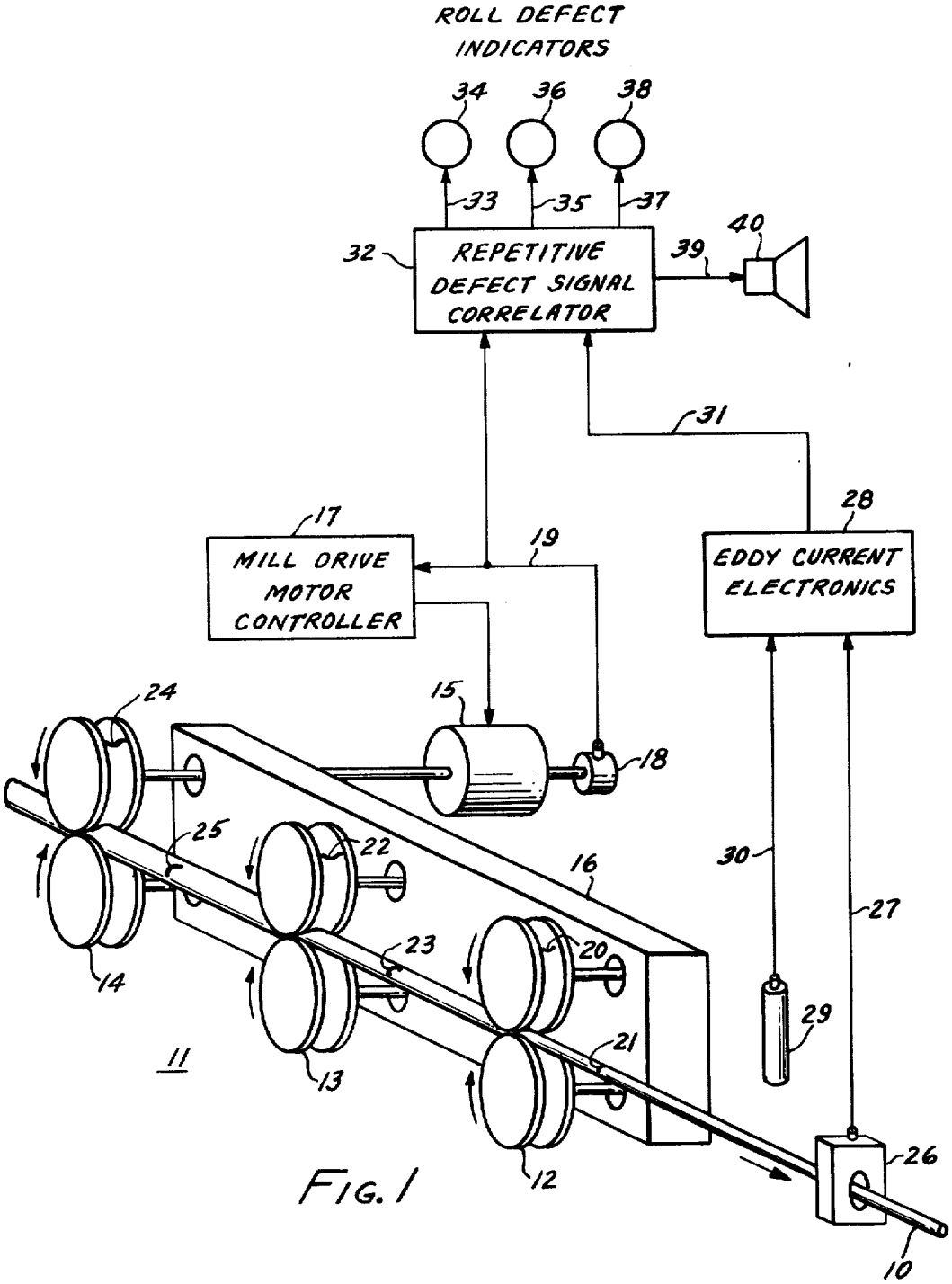
FIG. 1 is a schematic diagram of a roll mark detection system showing one embodiment of the invention in, for example, a highspeed steel rod rolling mill.

Referring now to the drawings, particularly FIG. 1, there is shown hot steel rod 10 being rolled by highspeed rolling mill 11. For purposes of illustration, rolling mill 11 has three sets of reducing rolls, 12, 13, 14 in a finishing stand which rotate in the direction shown by arrows adjacent the rolls. Each roll set 12, 13, 14 reduces the incoming crosssection of rod 10 a different fixed amount. To do this, the rotational speeds of roll sets 12, 13, 14 are selected such that the ratio of roll speeds between any two roll sets is equal to the ratio of rod 10 cross-sectional area reduction between the same two sets of rolls. In the present illustration, the ratio of roll speeds for roll set 13 is one-half that of roll set 12, and roll set 14 is one-third that of roll set 13, or one-sixth that of roll set 12.

In practice, there may be more than three reducing roll sets, or the roll speed ratio may be different than described above. Whichever is the case, all roll sets 12, 13, 14, and others if present, are driven by a common mill drive motor 15 through gear box 16 so that the speed relationship between roll sets 12, 13, 14 and others is maintained at a constant ratio as described above. Mill drive motor 15 is energized by mill drive motor controller 17 which causes roll speed to vary so that rod 10 may be produced at roll set 12 exit speeds of up to 3660 mpm (about 12,000 fpm).

The speed of mill drive motor 15 is sensed by clock source 18 which, for purposes of illustration, is a pulse tachometer that generates about 100 clock pulses per revolution of roll set 12. Clock source 18 clock pulses are fed over wire 19 to mill drive motor controller 17 in a feedback loop to maintain a preset mill speed by means not shown. Clock pulses are also fed over wire 19 to a correlator of the present invention that will be described below.

If rolling mill 11 where a highspeed bar mill instead of a rod mill, in all likelihood the rolled product would be reduced in separate finishing roll sets, each separately powered in feedback loops to maintain roll speed ratios constant. In this case, each mill roll set would be driven by a separate drive motor having separate clock pulse tachometer feedback to individual mill drive motor controllers (not shown). The separate clock pulses may be used in the correlator of this invention as described below.

Still referring to FIG. 1, cracked roll marks will now be described. If roll set 12 develops roll crack 20 a transverse defect 21 will occur on the surface of rod 10. Likewise, if roll set 13 develops roll crack 22 a transverse defect 23 will occur on the surface of rod 10. In addition, if roll set 14 develops roll crack 24 a transverse defect 25 will also occur on the surface of rod 10. These transverse defects 21, 23, 25 will continue to reoccur lengthwise on the surface of rod 10 until a cracked roll is replaced. The distance between recurrent transverse defects 21, 23, 25 is dependent upon which roll crack 20, 22, 24 caused the roll mark and a function of relative roll speed of roll sets 12, 13, 14, respectively. Although it appears from FIG. 1 that the distance between defects 21, 23, 25 is about the same, the distance will actually be substantially different due to the phenomenon that causes the reduction in cross-sectional area of rod 10.

This reduction and roll speed phenomenon produces plural repetitive rates of transverse defects 21, 23, 25 as follows. Transverse defects 21 have a first repetitive rate which is the highest of all repetitive defect rates because of the least distance between recurrent defects. Transverse defects 23 have a second repetitive rate which, as exemplified above, is one-half that of the first repetitive rate. Transverse defects 25 have a third repetitive rate which, as exemplified above, is one-third that of the second repetitive rate, or one-sixth of the first repetitive rate, because of the greatest distance between recurrent defects.

Figures 3A, 3B, 3C, 3D, 3E, 3F, 3G, 3H, 3J, 3K:
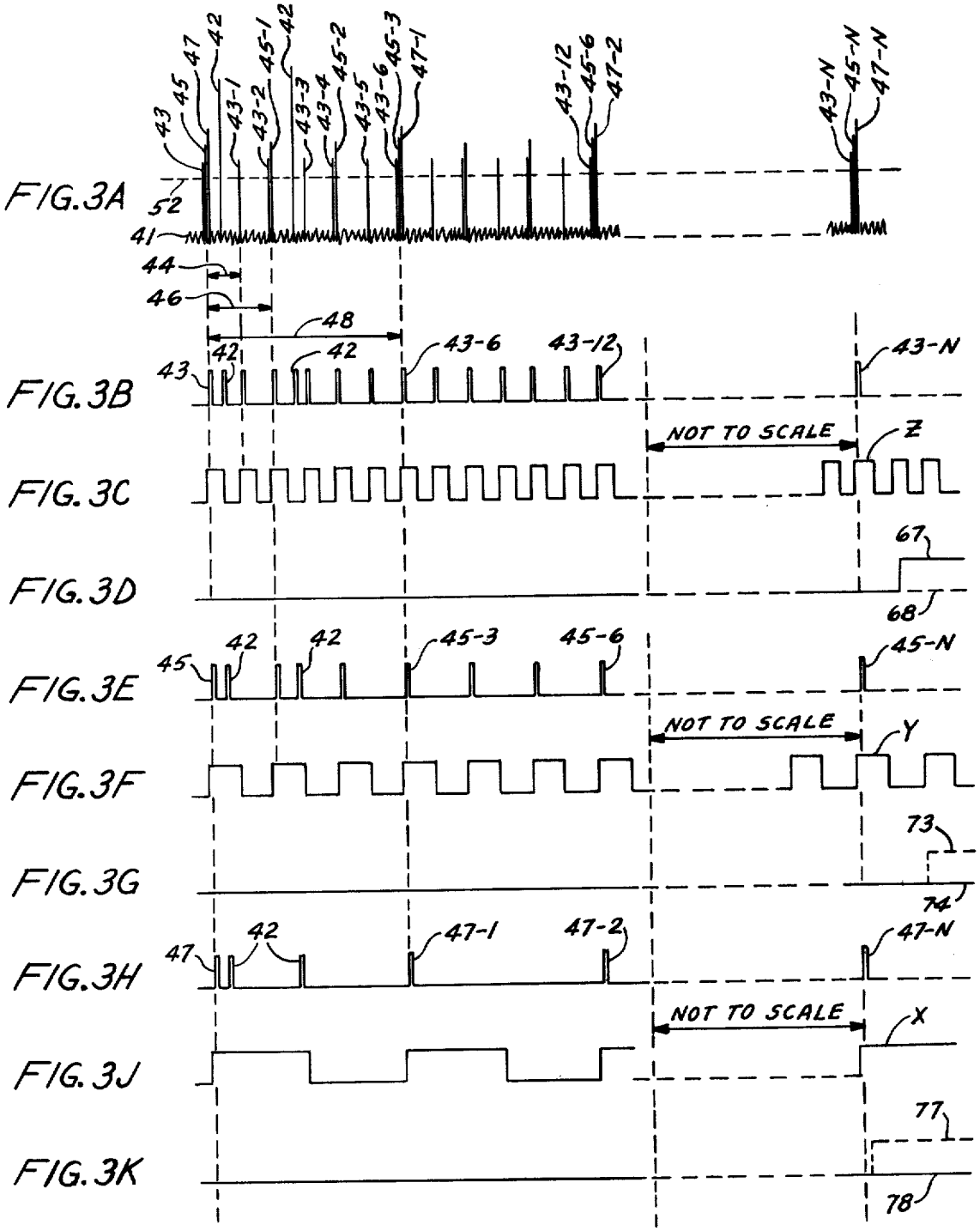
FIG. 3A shows graphically a variable repetitive defect signal to be processed in the selective correlator of FIG. 2.
FIG. 3B shows graphically a defect pulse train having a first repetitive rate interspersed with random false defect pulses.
FIG. 3C shows graphically a first clock pulse related to the first repetitive rate of the defect pulse train.
FIG. 3D shows graphically a first output signal of FIG. 2 correlator which is indicative of the presence of the first repetitive rate of the defect pulse train of FIG. 3A.
FIGS. 3E to 3G shows graphically a second repetitive rate of the defect pulse train, a second clock pulse and a correlator second output signal, all similar to FIGS. 3B to 3D, except occuring at one-half the first repetitive rate.
FIGS. 3H, 3J, 3K show graphically a third repetitive rate of the defect pulse train, a third clock pulse and a correlator third output signal, similar to FIGS. 3E to 3G, except occurring at one-third the second repetitive rate, or alternatively, one-sixth the first repetitive rate.

All repetitive defects 21, 23, 25, as well as false defects and surface scabs extending irregularly lengthwise on the surface of rod 10, are sensed by probe 26 as hot rod 10 moves therethrough at speeds up to 3660 mpm (about 12,000 fpm). Probe 26 consists of a stationary eddy-current test coil that produces repetitive defect signals as shown in FIG. 3A that are fed over wire 27 to eddy-current electronics 28. Eddy-current electronics 28, which are commercially available with high sensitivity, also responds to hot metal detector 29 that produces rod 10 presence/absence signals and sends them over wire 30.

Eddy-current electronics 28 is adapted to reduce probe 26 effective sensitivity, prior to sensing the head end of rod 10 and after sensing the trailing end of rod 10 in response to the presence/absence signal on wire 30, thereby preventing "ringing" of internal high sensitivity circuits not shown. Repetitive defect signals are conditioned within eddy-current electronics 28 and output on wire 31 in the form shown in FIG. 3A. It will be noted that random false defects are also included in a continuous background of noise.

Repetitive defect signals on wire 31, together with clock source pulses on wire 19, are fed to repetitive defect signal correlator 32. As described below, repetitive defect signal correlator 32 processes the repetitive defect signals in relation to the clock source pulses and determines which roll set 12, 13, 14 has a roll crack 20, 22, 24, respectively. If roll crack 20 produced transverse defect 21, correlator 32 will product a first output signal on wire 33 to activate roll defect indicator 34 which is indicative of a cracked roll in roll set 12. Further, if roll cracks 22, 24 produce transverse defects 23, 25, correlator 32 will produce respective second and third output signals on respective wires 35, 37 to activate respective roll defect indicators 36, 38 which are indicative of a cracked roll in roll set 13, 14. Moreover, whenever any of the roll defect indicators 34, 36, 38 are activated, correlator 32 will produce a fourth output signal on wire 39 which activates audible alarm 40 to warn rolling mill operating personnel of a cracked roll situation. A detailed description of correlator 32 follows.

Figure 2:
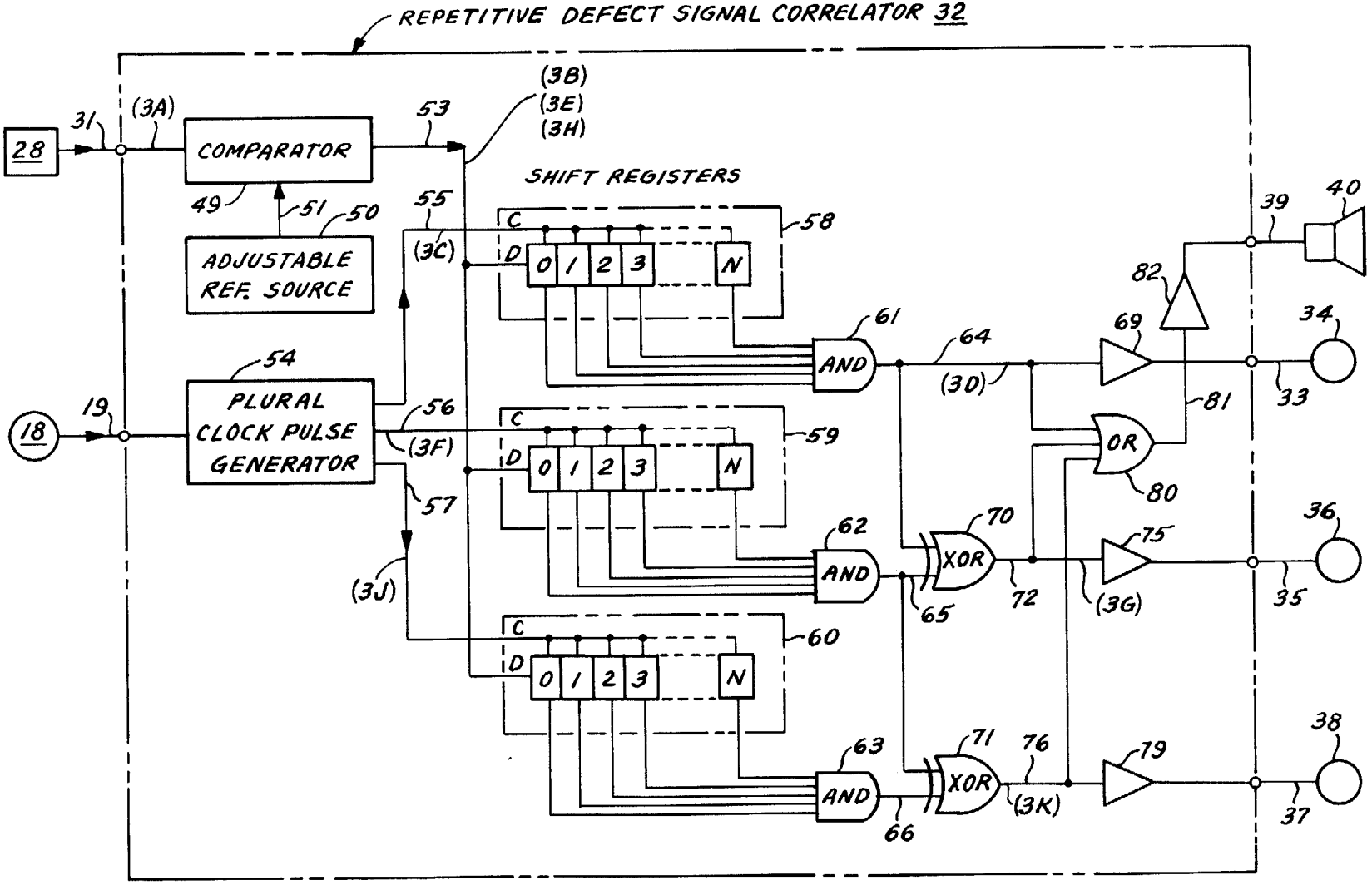
FIG. 2 is a block diagram of a selective correlator embodiment of the present invention shown in FIG. 1.

Turning now to FIGS. 2 and 3, the repetitive input signal fed over wire 31 to repetitive defect signal correlator 32, or simply correlator 32, is shown in FIG. 3A. All devices in correlator 32 are solid-state components operating at TTL levels unless otherwise noted. In FIG. 3A, the input signal is shown as a composite repetitive defect signal having various amplitudes, various repetitive rates of occurrancy, and a noisy background 41 and randomly occuring false defects 42.

Transverse defect 21 shown in FIG. 1, caused by roll crack 20 in roll set 12, will cause defect signal 43 (shown in heavy line) to be generated at repetitive interval 44, thereby establishing a first repetitive rate between defect signals 43, 43-1, 43-2, 43-3, 43-4, 43-5, 43-6, etc. Similarly, transverse defect 23, caused by roll crack 22 in roll set 13, will cause defect signal 45 to be generated at repetitive interval 46, thereby establishing a second repetitive rate between defect signals 45, 45-1, 45-2, 45-3, etc. Likewise, transverse defect 25, caused by roll crack 24 in roll set 14, will cause defect signal 47 to be generated at repetitive intervals 48, thereby establishing a third repetitive rate between defect signals 47, 47-1, etc. Further, if additional roll sets (not shown) are used in rolling mill 11, then a separate repetitive rate of transverse defects caused by each roll set will be generated.

Inasmuch as roll sets 12, 13, 14 are geared for a different, but constant, speed ratio, it is assumed that defect signals 43, 45, 47 will occur one at a time and begin at the same time interval shown in FIG. 3A waveform. However, defect signals 43-N, 45-N, 47-N end at different times because of their different rates. Defect signals 45 and 47 occur at respective one-half and one-sixth the repetitive rate of defect signals 43 shown in FIG. 3A waveform. Moreover, if additional roll sets are used, then the starting occurrence of other defect signals will be synchronized with defect signals 43, 45, 47.

It should be remembered that the total number of defect signals that occur for a given time interval will vary with mill 11 speed. The actual defect pulse count at 45-N and 47-N will be one-half and one-sixth the count at defect signal 43-N.

Referring now to FIG. 2, the repetitive defect signal correlator 32 is shown having comparator 49 receiving at one input the FIG. 3A repetitive defect signal 43, 45, 47 on wire 31. A second input of comparator 49 receives a constant, but programmable, reference voltage from adjustable reference source 50 by way of wire 51. Comparator 49 compares the instantaneous value of the repetitive defect signal on wire 31 with reference voltage 52 shown in FIG. 3A. When the input signal on wire 31 exceeds the reference voltage 52 level, comparator 49 produces an output on wire 53 which consists of a defect pulse train of constant TTL amplitude pulses representing the repetitive defect signals, false defect signals and intermittently occurring scab signals, all of which exceed reference voltage level 52. The reference voltage fixed at level 52 prevents background noise 41 and other low level false signals from being passed on to other circuits of correlator 32 and possibly interfering with the identification of true repetitive defect signals.

The repetitive defect pulse train present on wire 53 is shown in FIG. 3B for the first repetitive rate, FIG. 3E for the second repetitive rate, and FIG. 3H for the third repetitive rate. These defect pulses correspond to repetitive defect signals 43, 45, 47.

In order to correlate the various repetitive rates of the defect pulse trains shown in FIGS. 3B, 3E, 3H with a specific source, such as roll crack 20, 22, 24 in roll sets 12, 13, 14, plural clock pulse generator 54 generates as many different clock pulses streams as there are sources of repetitive rates of defect pulses. In the present embodiment, this is done by clock source pulses from device 18 fed over wire 19 being applied to a digital pulse divider network (not shown) within plural clock pulse generator 54. The pulse divider network generates three different clock pulse streams, shown in FIGS. 3C, 3F, 3J and outputs these on respective wires 55, 56, 57. Clock pulse stream shown in FIGS. 3C, 3F, 3J are proportional to the respective first, second and third repetitive rates of the defect signals. In addition, the ratio of clock frequencies is the same as the ratios of roll speeds in roll sets 12, 13, 14. Moreover, all clock frequencies vary as a function of clock source pulse frequency produced on wire 19 by device 18.

A predetermined number of defect pulses on wire 53 are stored in parallel temporarily in plural sequential storage means. One such storage arrangement is provided for each different repetitive rate of the defect pulse train as shown, for example, in FIGS. 3B, 3E, 3H. This is done in the present invention by shift registers 58, 59, 60, each having identical construction and made up with respective multiple elements 58-O to 58-N, 59-O to 59-N and 60-O to 60-N. N is an integer number selected for the desired correlation accuracy, the larger the number the better immunity to noise signal 41. In practice, one integer that has been satisfactory is where N is equal to 116 storage elements.

Each shift register 58, 59, 60 has a data input (D) connected in parallel to wire 53 so as to receive any of the defect pulse trains shown in FIGS. 3B, 3E, 3H. In addition, each shift register 58, 59, 60 has a clock input (C) which receives a different clock pulse train over wires 55, 56, 57, respectively, these being shown in FIGS. 3C, 3F, 3J, respectively. Each positive clock pulse on a clock input shifts a defect pulse on the data input to the first element 58-O, 59-O, 60-O. Each successive positive clock pulse shifts defect pulse data in any element to a higher number adjacent element until elements 58-N, 59-N, 60-N are reached.

Defect pulses, including repetitive defects, random false defects and irregular scab defects, shown in FIG. 3B defect pulse train are clocked through shift register 58 by FIG. 3C clock pulses having the first or highest of the repetitive rates. Similarly, defect pulses in FIG. 3E are clocked through shift register 59 by FIG. 3F clock pulses having the second or next highest of the repetitive rates. Likewise defect pulses in FIG. 3H are clocked through shift register 60 by FIG. 3J clock pulses having the third or lowest of the repetitive rates. Defect pulse count in each shift register 58, 59, 60 at any instant will be in the ratio of six-to-two-to-one, respectively.

If true defect signals 43, 45, 47, causing the production of corresponding defect pulses in the train, occur more frequently than respective clock pulses FIGS. 3C, 3F, 3J in respective shift registers 58, 59, 50, each such shift register will contain true defect signals in each respective elements 58-O to 58-N, 59-O to 59-N, 60-O to 60-N after respective Z, Y, X clock pulses shown in FIGS. 3C, 3F, 3J. Conversely, if clock pulses FIGS. 3C, 3F, 3J occur more frequently that true defect signals 43, 45, 47, each shift register will have some elements 58-O to 58-N, 59-O to 59-N, 60-O to 60-N that will not contain true defect pulses in every element. Random false defect signals 42, as well as irregular scab signals, will cause corresponding defect pulses in the pulse train to be clocked through a shift register 58, 59, 50 as a true defect signal. However, if the integer N elements in each shift register 58, 59, 60 is large enough, as suggested above, then the random false defect and scab pulses will not cause false correlation with any clock pulse for reasons that will become evident from the description below.

Each shift register output from respective groups of elements 58-O to 58-N, 59-O to 59-N, 60-O to 60-N are fed to logic means for determining which of the three repetitive rates is present in the defect signal train. Presently, respective logic AND gates 61, 62, 63 are used in sense each group of outputs of shift register elements 58-O to 58-N, 59-O to 59-N, 60-O to 60-N, respectively. Each input of AND gate 61, 62, 63 is connected to a predetermined number P of elements of output in shift registers 58, 59, 60, thereby requiring each AND gate to have P inputs.

In order for the output of any AND gate 61, 62, 63 to be true, each input must be true. Hence, there must be a full match of shift register grouped outputs 58-O to 58-N, 59-O to 59-N, 60-O to 60-N, for a respective AND gate 61, 62, 63 output to be true. AND gate 61, 62, 63 output is present on respective wires 64, 65, 66. Since more than one AND gate 61, 62, 63 may have a true output at the same instant, the AND gate representing correlation of the defect pulse train in the correct shift register 58, 59, 60 must be sensed.

Correlation of the first repetitive defect pulses in pulse train FIG. 3B with the first clock pulse FIG. 3C will normally take place in shift register 58 after 43-N defect pulses and Z quantity of first clock pulses. After this clock count of Z, all AND gate 61 inputs will be true, therefore its output on wire 64 will be true. This true condition is in itself indicative of the presence of the first repetitive rate of the defect pulse train and is represented in FIG. 3D by the onset of pulse 67. If all inputs to AND gate 61 are not true after Z first clock pulses, then AND gate 61 output will be false and its output will remain low as shown at dotted line 68.

Driver 69 amplifies AND gate 61 output on wire 64 and provides a first output signal on wire 33 of sufficient magnitude to activate indicator 34. As described above, the first output signal is indicative of the first repetitive rate of the defect pulse train which is associated with roll crack 21 in roll set 12. The first output signal is sustained as long as a full match exists between all shift register 58 outputs 58-O to 58-N and all inputs of AND gate 61.

Correlation of the second or third repetitive defect pulses in respective pulse trains FIGS. 3E, 3H with respective second and third clock pulses FIGS. 3F, 3J will normally take place in respective shift register 59, 60 after respective 45-N and 47-N defect pulses and Y and X quantity of second and third clock pulses, respectively. After these clock counts of Y and X, all respective inputs to AND gates 62, 63 will be true, therefore their outputs on respective wires 65, 66 will be true. These true conditions are indicative of the presence of the respective second or third repetitive rate of the defect pulse trains. However, inasmuch as each AND gate 61, 62, 63 receives inputs at different rates, their full match of 43-N, 45-N and 47-N of true inputs are in fact achieved at different time intervals. When AND gate 61 output is true, AND gates 62, 63 are false because shift registers 59, 60 are not full, since their clock rates are slower than that of shift register 58 clock rate. However, after N clock pulses at respective second and third repetitive rates, shift registers 59, 60 respectively will be full. In addition, when AND gate 62 output is true because of a second repetitive rate occurrence, AND gate 61 output will be false because both true and false defect pulses are clocked through shift register 58. AND gate 63 has no full match, therefore its output is also false, until shift register 60 fills up and AND gate 63 goes true, similarly, in the case of the third respective defect rate, when AND gate 63 output is true, AND gates 61, 62 are false because both true and false defect pulses are clocked through shift registers 58, 59, respectively.

Because more than one AND gate 61, 62, 63 may have a true output at the same time, correlator 32 is provided with additional logic means for sensing the correlation of the second and third repetitive rates of the defect pulse train with reference to shift registers 59, 60. For this reason, exclusive OR (XOR) gates 70, 71 are provided to compare the outputs of adjacent AND gates 61, 62, 63, respectively. The output of XOR gates 70, 71 is true only if its inputs are different, that is, if one input is true and the other input is false. XOR gates 70, 71 look for an AND gate 61, 62, 63 with a true output adjacent an AND gate with false output after Z, Y, X quantity of clock pulses.

Correlation of the second repetitive rate of the defect pulse train occurs when the inputs to XOR gate 70 receives a false output from AND gate 61 and a true output from AND gate 62. XOR gate 70 output is true, this being present on wire 72, and represented in FIG. 3G by the onset of a pulse shown at dotted line 73. At all other times, XOR gate 70 output is false as shown by solid line 74.

Driver 75 amplifies XOR gate 70 output on wire 72 and provides a second output signal on wire 35 of sufficient magnitude to activate indicator 36. As described above, the second output signal is indicative of the second repetitive rate of the defect pulse train which is associated with roll crack 22 in roll set 13. The second output signal is sustained as long as a full match exits between all shift register 59 outputs 59-O to 59-N and all the inputs to AND gate 62.

Correlation of the third repetitive rate of the defect pulse train occurs when the inputs to XOR gate 71 receives a false output from AND gate 62 and a true output from AND gate 63. XOR gate 71 output is true, this being present on wire 76, and represented in FIG. 3K by the onset of a pulse shown at dotted line 77. At all other times, XOR gate 71 output is false as shown by solid line 78.

Driver 79 amplifies XOR gate 71 output on wire 76 and provides a third output signal on wire 37 of sufficient magnitude to activate indicator 38. As described above, the third output signal is indicative of the third repetitive rate of the defect pulse train which is associated with roll crack 24 in roll set 14. The third output signal is sustained as long as a full match exists between all shift register 60 outputs 60-O to 60-N and all the inputs to AND gate 63.

Correlator 32 includes further logic means for sensing the presence of any repetitive rate of any of the defect pulse trains 3B, 3E, 3H. For this reason, OR gate 80 is provided to receive any of the three output signals on wires 64, 72, 76. OR gate 80 output is true when any of the three output signals is true, this being present on wire 81 for the duration of full match of any AND gate 61, 62, 63 inputs. Driver 82 amplifies OR gate 80 output and provides a fourth output signal on wire 39 of sufficient magnitude to activate audible alarm 40. The fourth output signal and audible alarm is indicative that any one of the roll sets 12, 13, 14 has a roll crack 20, 22, 24.

Due to the irregular nature of scab defect signals, it is unlikely that an unbroken string of N integer defect pulses would be produced on the surface of bar 10 so as to be clocked through shift registers 58, 59, 60 and provide a full match at the inputs of either AND gate 61, 62, 63. However, if this remote possibility should happen, any one of indicators 34, 36, 38 might flicker momentarily until scab defect pulses with magnitudes of less than a reference voltage level 52 and recurrent rates less than the third repetitive rate will provide a false output of one of each shift register elements, thereby causing an AND gate output to be false. Hence, there is no full match between shift register output and AND gate input to sustain any output signal from correlator 32.

If a mill operating condition should arise where the unlikely situation of more than one set of mill rolls 12, 13, 14 in FIG. 1 should develop a crack at one time, the present invention will still operate as follows. Probe 26 will sense multiple repetitive defect signals which are fed to eddy-current electronics 28 and subsequently to repetitive defect signal correlator 32. Here they will be clocked through one or more shift registers, depending on the complexity of multiple repetitive defect pulse train. One indicator and the audible alarm will be activated to warn mill operating personnel of a cracked roll condition.

We claim:

1. Apparatus for selectively detecting variable repetitive input signals according to one of plural repetitive rates, comprising:

(a) means for producing a pulse train of essentially repetitive input signals which exceed a predetermined amplitude above a noise level, (b) means including clock means responsive to an external clock source for generating plural clock pulses each related to one of the plural repetitive rates, and further including plural storage circuits having parallel-connected data inputs, each storage circuit sequentially and temporarily storing a predetermined number of said train pulses in response to a different one of said clock pulses, each storage circuit having plural element outputs grouped according to one of the repetitive rates, and (c) means receiving each group of storage circuit outputs for selectively producing one of plural output pulses indicative of a particular one of the plural repetitive rates of the input signal.

2. The apparatus of claim 1 where in the plural repetitive rates of the input signals have a predetermined proportion to each other.

3. The apparatus of claim 1 wherein means (a) includes comparator means receiving the repetitive input signal and produces the pulse train, and further including an adjustable reference source for establishing the comparator means amplitude above which the pulse train is produced.

4. The apparatus of claim 1 wherein the means (b) plural storage circuits each consist of a shift register have the same pulse train data sequenced by a different clock rate provided by the clock means.

5. The apparatus of claim 1 wherein means (c) comprises logic means including a separate AND gate connected to each group of storage element outputs and enabled by a full match of storage element outputs, thereby causing the production of a corresponding one of the plural output pulses.

6. The apparatus of claim 5 wherein the means (c) logic means further includes one less XOR gate than AND gates and which are operatively associated with all AND gates for causing the production of all but a predetermined one of the plural output pulses.

7. The apparatus of claim 1 wherein means (c) comprises logic means including an OR gate responsive to any one of the plural output pulses for signalling the fulfillment of a predetermined number of train pulses in any of the storage circuits in means (b).

8. The apparatus of claim 1 further including means responsive to any one or all of the means (c) plural output pulses for signalling the presence of a corresponding any one or all of the repetitive rates of the input signal.

9. In a rolling mill having defect detecting means, apparatus for selectively detecting variable repetitive roll defect signals according to one of plural repetitive rates corresponding to different speeds of plural mill rolls, comprising:

(a) means for producing a defect pulse train of essentially repetitive defect signals which exceed a predetermined defect amplitude above a noise level, (b) a clock source coupled to a rolling mill roll drive mechanism, (c) means including clock means responsive to the clock source for generating plural clock pulses each related to one of the plural defect signal repetitive rates, and further including plural shift registers having parallel-connected data inputs, each shift register for sequentially and temporarily storing a predetermined number of defect pulses in response to a different one of said clock pulses, each shift register having plural element outputs grouped according to one of the defect signal repetitive rates, and (d) logic means receiving each group of shift register outputs for selectively producing one of plural output signals indicative of which particular mill roll is causing the repetitive defect signal.

10. The apparatus of claim 9 wherein the plural repetitive rates of the defect signals correspond to a predetermined proportion of mill roll speeds.

11. The apparatus of claim 9 further including means responsive to any of the plural output pulses for signalling which particular mill roll is causing the repetitive roll defect signal.

* * * * *